US007355525B2

(12) United States Patent
Tengler et al.

(10) Patent No.: US 7,355,525 B2
(45) Date of Patent: Apr. 8, 2008

(54) VEHICLE COMMUNICATION SYSTEM

(75) Inventors: Steve Tengler, Groose Pointe Park, MI (US); Ronald Heft, Farmington Hills, MI (US)

(73) Assignee: Nissan Technical Center North America, Inc. MI (US)

( * ) Notice: Subject to any disclaimer, the term of this patent is extended or adjusted under 35 U.S.C. 154(b) by 154 days.

(21) Appl. No.: 11/314,180

(22) Filed: Dec. 22, 2005

(65) Prior Publication Data

US 2007/0146162 A1 Jun. 28, 2007

(51) Int. Cl.
*G08G 1/09* (2006.01)

(52) U.S. Cl. ..... 340/905; 340/10.2; 340/933; 701/96; 701/93; 701/70

(58) Field of Classification Search ..... 340/905, 340/907, 933, 903, 902, 901, 928, 436, 988, 340/425.5, 435, 10.2; 701/200, 207, 93, 701/96, 70; 342/357.06, 357.08
See application file for complete search history.

(56) References Cited

U.S. PATENT DOCUMENTS 5,313,200 A * 5/1994 Sone ..... 340/905
6,236,933 B1 * 5/2001 Lang ..... 701/117
6,653,946 B1 * 11/2003 Hassett ..... 340/928
7,188,026 B2 * 3/2007 Tzamaloukas ..... 701/200

* cited by examiner

*Primary Examiner*—Benjamin C. Lee
*Assistant Examiner*—Daniel Previl
(74) *Attorney, Agent, or Firm*—Global IP Counselors

(57) ABSTRACT

A vehicle communication system is provide with a host vehicle two way communication device, an omni-directional antenna, a bi-directional antenna, a vehicle positioning component, a vehicle map component and at least one of a vehicle broadcast power modulating component and a bi-directional antenna aiming component. The vehicle map component includes road data with roads being classified by at least one of a road segment attribute. The vehicle broadcast power modulating component selectively varies broadcast power of the omni-directional antenna and broadcast power of the bi-directional antenna based on a road segment attribute of a road on which the host vehicle is traveling on as determined by the vehicle positioning component. The bi-directional antenna aiming component aims the bi-directional antenna based on at least one of traffic information received by the communication device and the road segment attribute of the road on which the host vehicle is traveling on.

19 Claims, 11 Drawing Sheets

VEHICLE COMMUNICATION SYSTEM

BACKGROUND OF THE INVENTION

1. Field of the Invention

The present invention generally relates to a vehicle communication system for direct communication between vehicles. More specifically, the present invention relates to a vehicle communication system that uses an omni-directional antenna and a bi-directional antenna to assist the driver obtain road information.

2. Background Information

Recently, vehicles are being equipped with a variety of informational systems such as navigation systems, Sirius and XM satellite radio systems, the so-called CLARUS weather information system, two-way satellite services, built-in cell phones, DVD players and the like. These systems are sometimes interconnected for increased functionality. Various informational systems have been proposed that use wireless communications between vehicles and between infrastructures, such as roadside units. These wireless communication systems have a wide range of applications ranging from crash avoidance to entertainment systems. Enabling these communication systems might be possible with varying costs and capabilities. Thus, the type of wireless communication systems to be used depends on the particular application. Some examples of wireless technologies that are currently available include digital cellular systems, Bluetooth systems, wireless LAN systems and dedicated short range communications (DSRC) systems.

Dedicated short range communications (DSRC) is an emerging technology that has been recently investigated for suitability in vehicles for a wide range of applications. Communications between vehicles and to/from infrastructure will enable a vast number of potential systems ranging from crash avoidance to Internet entertainment systems.

DSRC technology will allow vehicles to communicate directly with other vehicles and with roadside units to exchange a wide range of information. In the United States, DSRC technology will use a high frequency radio transmission (5.9 GHz) that offers the potential to effectively support wireless data communications between vehicles, and between vehicles, roadside units and other infrastructure. The important feature of DSRC technology is that the latency time between communications is very low compared to most other technologies that are currently available. Another important feature of DSRC technology is the capability of conducting both point-to-point wireless communications and broadcast wireless messages in a limited broadcast area.

Accordingly, DSRC technology can be used to provide various information between vehicles and to/from infrastructure, and from vehicle-to-vehicle, such as providing GPS location, vehicle speed and other vehicle Parameter Identifiers (PIDs) including engine speed, engine run time, engine coolant temperature, barometric pressure, etc. When communications are established from one vehicle to other vehicles in close proximity, this information would be communicated between the vehicles to provide the vehicles with a complete understanding of the vehicles in the broadcast area. This information then can be used by the vehicles for both vehicle safety applications and non-safety applications.

In vehicle safety applications, a "Common Message Set" (CMS) would mostly likely be developed in which a prescribed set of vehicle Parameter Identifiers (PIDs) are broadcast by each vehicle to give relevant kinematical and location information such as GPS location/vehicle position, vehicle speed, vehicle dimensions etc. Once a potential safety concern is determined to exist, a warning system in the vehicles would notify the driver of the potential safety concern so that the driver can take the appropriate action.

In non-safety applications, a DSRC vehicle on-board unit would most likely provide an encrypted User ID that would coordinate with a specific account on a service provider's look-up table. Once the vehicle on-board unit establishes a link to the service provider, the vehicle on-board unit can be provided with various services associated with the specific account such as point of interest notification, map update download, in-route hotel reservations, etc. through a roadside unit in close proximity that is linked to the service provider.

Currently, DSRC equipped vehicles use a single omni-directional antenna that covers a prescribed radius about the vehicle. In a multi-lane highway scenario, the DSRC interference and backend calculations could be enormous given the extreme amount of information that could eventually be communicated between vehicles. Thus, it is desirable to minimize the DSRC interference and backend calculations.

In view of the above, it will be apparent to those skilled in the art from this disclosure that there exists a need for an improved vehicle communication system. This invention addresses this need in the art as well as other needs, which will become apparent to those skilled in the art from this disclosure.

SUMMARY OF THE INVENTION

In view of the above, it has been discovered that using a bi-directional antenna together with an omni-directional antenna can minimizes the DSRC interference and backend calculations. Thus, one object of the present invention is to provide a vehicle communication system that minimizes the DSRC interference and backend calculations.

In accordance with one aspect of the present invention, the forgoing object can basically be attained by providing a vehicle communication system that comprises a host vehicle two way communication device, an omni-directional antenna, a bi-directional antenna, a vehicle positioning component, a vehicle map component and a vehicle broadcast power modulating component. The host vehicle two way communication device is configured to conduct short range communications in a host vehicle broadcast area surrounding a host vehicle equipped with the vehicle communication system. The omni-directional antenna is operatively coupled to the host vehicle two way communication device to conduct short range communications in the host vehicle broadcast area surrounding the host vehicle. The bi-directional antenna is operatively coupled to the host vehicle two way communication device to conduct short range communications in the broadcast area surrounding the host vehicle. The vehicle positioning component configured to determine a host vehicle position of the host vehicle. The vehicle map component including road data with roads being classified by at least one of a road segment attribute. The vehicle broadcast power modulating component configured to selectively vary broadcast power of the omni-directional antenna and broadcast power of the bi-directional antenna based on the road segment attribute of a road on which the host vehicle is traveling on as determined by the vehicle positioning component.

In accordance with another aspect of the present invention, the forgoing object can basically be attained by providing a vehicle communication system that comprises a host vehicle two way communication device, an omni-directional antenna, a bi-directional antenna, a vehicle positioning component, a vehicle map component and a bi-directional antenna aiming component. The host vehicle two way communication device is configured to conduct short range communications in a host vehicle broadcast area surrounding a host vehicle equipped with the vehicle communication system. The omni-directional antenna is operatively coupled to the host vehicle two way communication device to conduct short range communications in the host vehicle broadcast area surrounding the host vehicle. The bi-directional antenna is operatively coupled to the host vehicle two way communication device to conduct short range communications in the broadcast area surrounding the host vehicle. The bi-directional antenna is configured to be selectively aimed within a predetermined range of movement. The vehicle positioning component configured to determine a host vehicle position of the host vehicle. The vehicle map component including road data with roads being classified by at least one of a road segment attribute. The bi-directional antenna aiming component is configured to aim the bi-directional antenna based on at least one of traffic information received by the host vehicle two way communication device and the road segment attribute of the road on which the host vehicle is traveling on.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
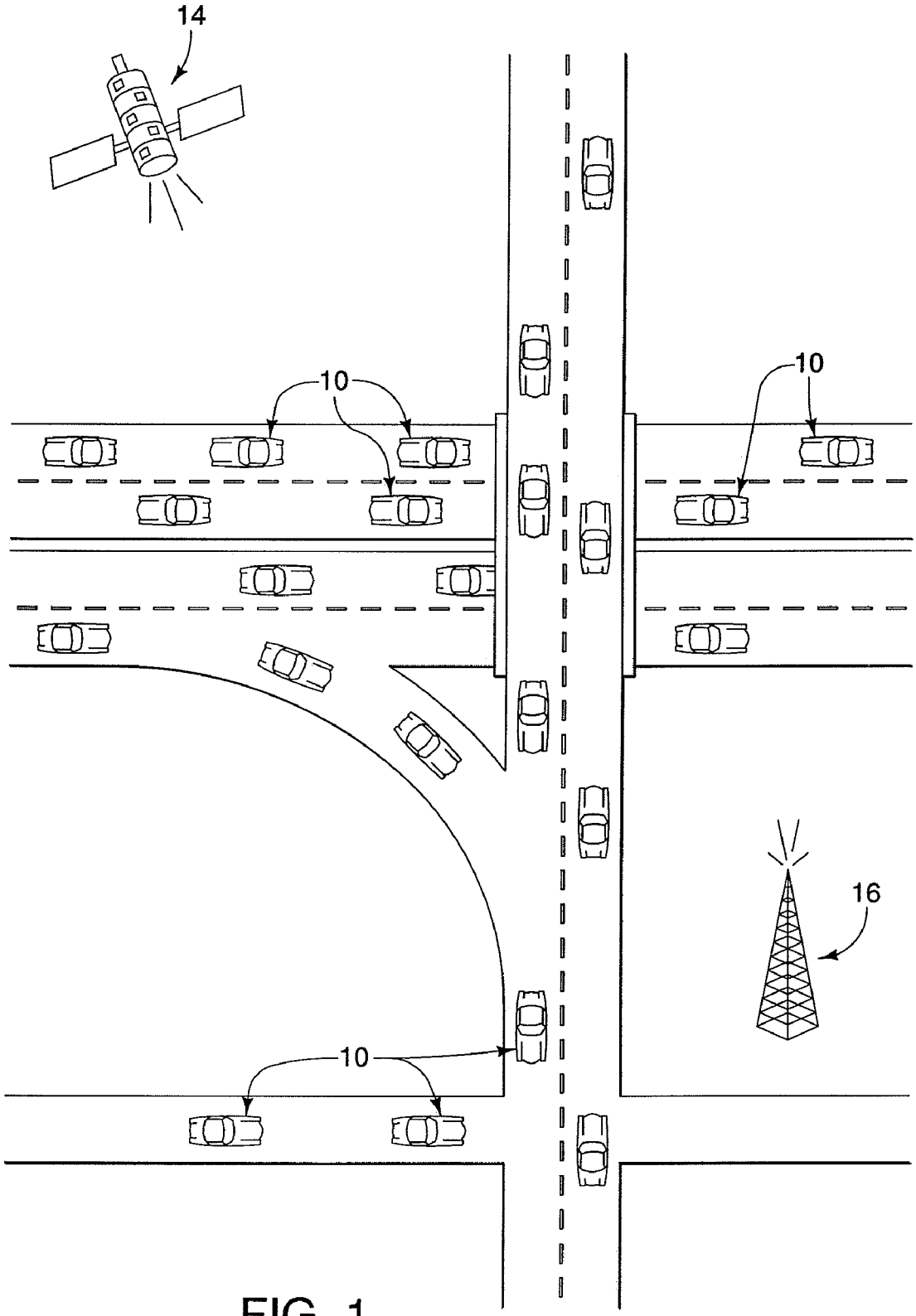
FIG. 1 is a pictorial representation of a two-way wireless communications (DSRC) network showing a plurality of vehicles each being equipped with a vehicle on-board unit capable of conducting two-way wireless communications in accordance with the present invention.
Figure 2:
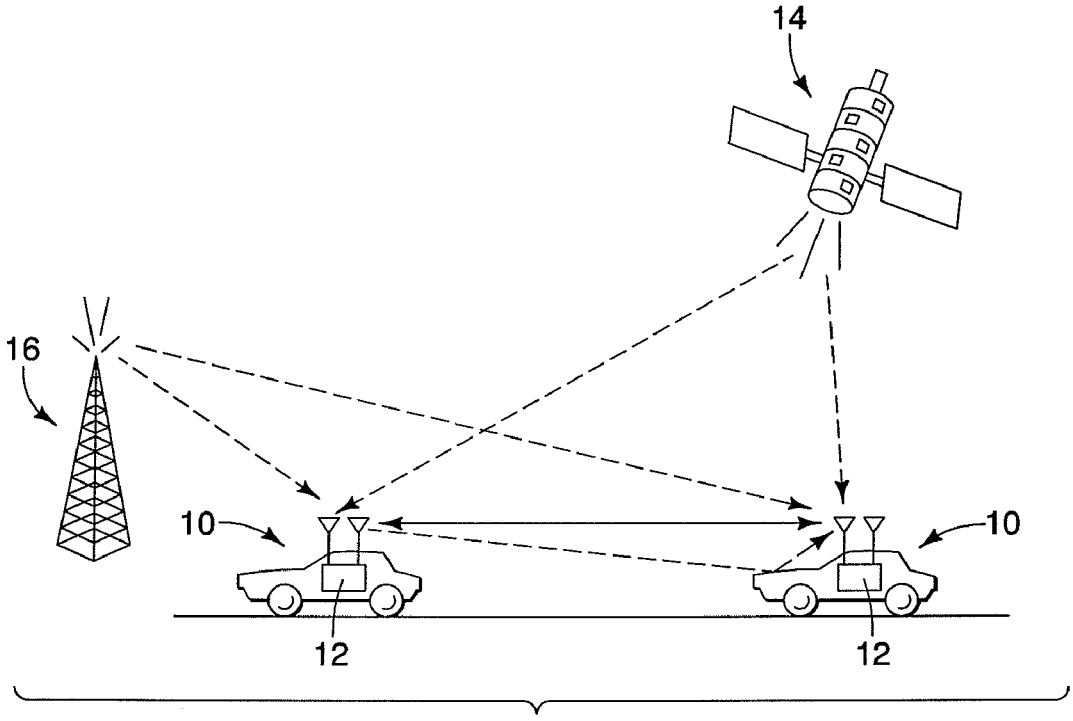
FIG. 2 is a pictorial representation of a two-way wireless communications (DSRC) network showing a pair of vehicles broadcasting vehicle identifiers and receiving information from a satellite and/or a roadside unit in accordance with the present invention.

Referring initially to FIGS. 1 and 2, a two-way wireless communications network is illustrated in which a plurality of vehicles 10 that are each equipped with a vehicle communication system (on-board unit) 12 in accordance with one embodiment of the present invention. The two-way wireless communications network also includes one or more global positioning satellites 14 (only one shown) and one or more roadside units 16 (only one shown) that send and receive signals to and from the vehicles 10. In the preferred embodiment, the on-board units 12 of the vehicles 10 are preferably a dedicated short range communications (DSRC) on-board unit that can communicate with the roadside units 16 within the two-way wireless communications network. Thus, the roadside units 16 are configured and arranged with DSRC equipment that sends and receives signals to and from the vehicles 10. More specifically, each of the roadside units 16 is equipped with a DSRC unit for broadcasting and receiving signals to the vehicles 10 located with a prescribed communication (broadcasting/receiving) region surrounding the roadside units 16, respectively. Moreover, each of each of the roadside units 16 and is preferably an IP enabled structure that is configured and arranged to establish a link between the vehicle on-board unit 12 of the host vehicle 10. Such DSRC units for the roadside units 16 can be conventional equipment that is known in the art. Since the roadside units 16 can be can be equipment that is known in the art, the structures of the roadside units 16 will not be discussed or illustrated in detail herein. Rather, it will be apparent to those skilled in the art from this disclosure that the equipment of the roadside units 16 can be any type of structure that can be used to carry out the present invention.

In this system, the term "host vehicle" refers to a vehicle among a group of DSRC equipped vehicles or vehicles equipped with two-way wireless communications in accordance with the present invention. The term "neighboring vehicle" refers to DSRC equipped vehicles or vehicles equipped with two-way wireless communications that are located within a communication (broadcasting/receiving) area surrounding the host vehicle in which the host vehicle is capable of either broadcasting a signal to another vehicle within a certain range and/or receiving a signal from another vehicle within a certain range. The term "neighboring roadside unit" refers to DSRC equipped roadside unit that is equipped with two-way wireless communications and that is located within a communication (broadcasting/receiving) area surrounding the host vehicle.

Figure 3:
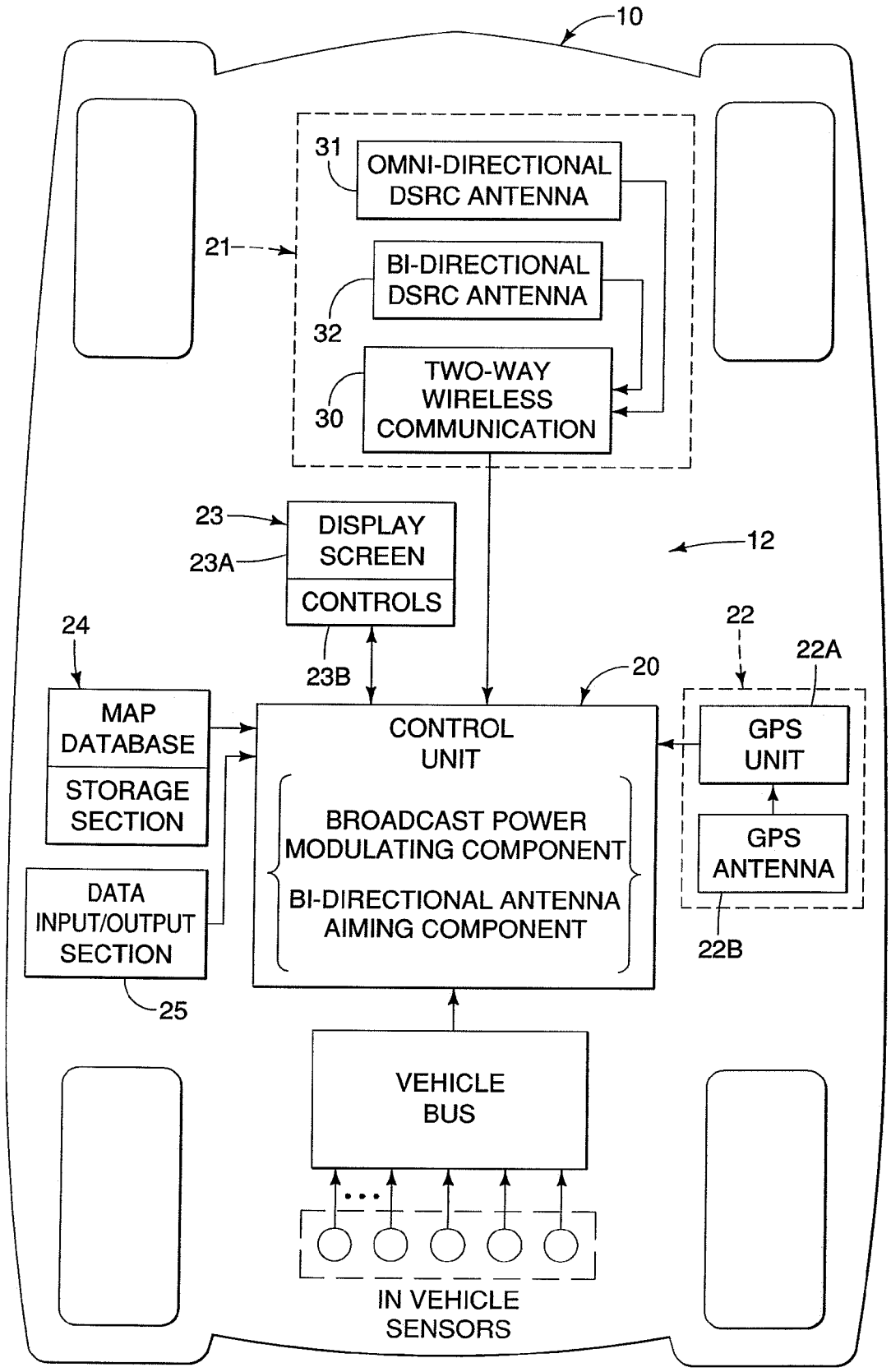
FIG. 3 is a schematic representation of one of the vehicles that is equipped with the vehicle on-board unit for conducting two-way wireless communications in accordance with the present invention.
Figure 4:
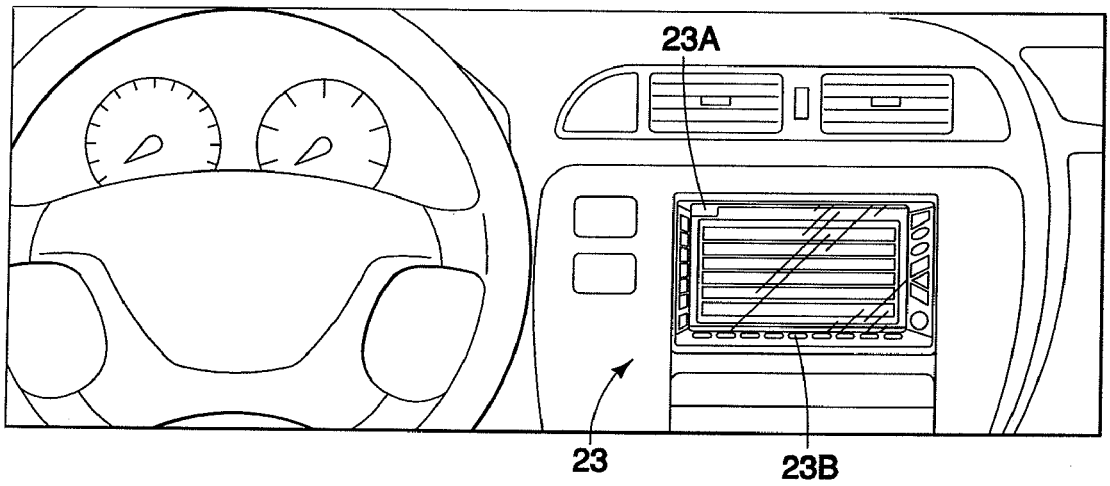
FIG. 4 is an inside elevational view of a portion of the vehicle's interior that is equipped with the on-board unit for conducting two-way wireless communications in accordance with the present invention.

Referring now to FIG. 3, the vehicle on-board unit (OBU) 12 of the present invention basically includes a controller or control unit 20, a two-way wireless communication system 21 (a short range wireless communication component), a global positioning system 22 (a vehicle positioning component), an onboard vehicle navigation system 23 (a vehicle guiding component), a map database 24 (a vehicle map component) and a data input/output section 25. These systems or components are configured and arranged such that the control unit 20 receives and/or sends various signals to other DSRC equipped component and systems in the communication (broadcasting/receiving) area that surrounds the host vehicle 10. Moreover, the control unit 20 of the vehicle on-board unit 12 is configured to receive detection signals from various in-vehicle sensors including, but not limited to, a fuel sensor, an ignition switch sensor, a steering angle sensor, a vehicle speed sensor, an acceleration sensor, etc. The vehicle on-board unit 12 together with the in vehicle sensors forms a vehicle communication system.

Basically, the control unit 20 includes various control programs that operate the two-way wireless communication system 21, the global positioning system 22, the onboard vehicle navigation system 23 and the map database storage section or component 24. In particular, the control unit 20 is configured and/or programmed to carry out control of the two-way wireless communication system 21 by executing the steps shown in the flow chart of FIG. 13 (discussed below) using information obtained from the global positioning system 22, the onboard vehicle navigation system 23 and/or the map database storage section or component 24. The control unit 20 and its various components will be typically activated when the user turns the ignition key to the "ON" position or the "Accessory" position. Thus, an ignition switch sensor is configured and arranged to activate the control unit 20 and start the process of FIG. 13 (discussed below).

The control unit 20 preferably includes a microcomputer with a control program. The control unit 20 is configured to control the two-way wireless communication system 21 to minimize the DSRC interference and backend calculations. In particular, as seen in FIG. 3, the control unit 20 has a broadcast power modulating component and a bi-directional aiming component as discussed below.

The control unit 20 in one preferred embodiment is integrated into the navigation system 23 such that they share common inputs and outputs. In other words, the controls (inputs and outputs) for operating the navigation system 23 are also used to operate the vehicle communication system 12 to carry out the present invention. Alternatively, separate controls can be used for the vehicle communication system 12 and the navigation system 23. In any event, the control unit 20 also preferably includes other conventional components such as an input interface circuit, an output interface circuit, and storage devices such as a ROM (Read Only Memory) device and a RAM (Random Access Memory) device. The memory circuit stores processing results and control programs such as ones for operation of the two-way wireless communication system 21, the global positioning system 22, the navigation system 23 and the map database 24 that are run by the processor. The control unit 20 is capable of selectively controlling other DSRC components of the vehicle such as other safety systems as needed and/or desired. It will be apparent to those skilled in the art from this disclosure that the precise structure and algorithms for the control unit 20 can be any combination of hardware and software that will carry out the functions of the present invention.

The two-way wireless communication system 21 includes communication interface circuitry that connects and exchanges information with a plurality of the vehicles 10 that are similarly equipped as well as with the roadside units 16 through a wireless network within the broadcast range of the host vehicle 10. The two-way wireless communication system 21 is configured and arranged to conduct direct two way communications between vehicles (vehicle-to-vehicle communications) and roadside units (roadside-to-vehicle communications). Moreover, two-way wireless communication system 21 is configured to periodically broadcast a signal in the broadcast area. Thus, the two-way wireless communication system 21 includes a regular broadcast channel and a service channel.

As seen in FIG. 3, the two-way wireless communication system 21 is an on-board unit that at least includes a host vehicle two way communication device 30, an omni-directional antenna 31 and a bi-directional (multi-directional) antenna 32. The two-way wireless communication system 21 has a dual purpose of augmenting the signal quality of the radio-based system through more focused transmission of radio signals and enhancing capacity through increased frequency reuse. Thus, using these two antennas 31 and 31 in concert with the global positioning system 22, the navigation system 23 and the map database 24, the broadcast power modulating component of the control unit 20 can keep the omni-directional power high during suburban/rural driving, and inversely raise the directional antenna's power when the system recognizes the vehicle on a highway. This would reduce the number of unnecessary vehicles receiving the information, reduce the interference with other signals, and increase the reliability of packet reception. In addition, since fewer packets would be received, it would reduce the size of the processor required to analyze the incoming data, which means a hardware & software cost save along with decreased system latency. Moreover, the bi-directional aiming component of the control unit 20 aims the bi-directional antenna 32 acts so that it acts as an "electronic eye" that is aim towards the pertinent traffic. In the case of the highway driving, it is desirable take into account slight variances in the directionality of the signal and diversity checking to ensure that the bi-directional antenna 32 properly aimed.

The control unit 20 is configured to selectively control the two way communication device 30, the omni-directional antenna 31 and the bi-directional antenna 32 to minimize the DSRC interference and backend calculations. Moreover, using the omni-directional antenna 31 and the bi-directional antenna 32 will also help bolster reliability of the gathering of information packets and enable multi-channel monitoring (i.e. the host vehicle 10 could receive an MP3 download on one channel and still listen for a possible crash condition on a different channel). However, another constraint will be the balancing act between (1) raising the power/range HIGH enough to communicate the message to the necessary vehicles in the vicinity, (2) lowering the power/range LOW enough to avoid interference with other vehicles' signals, and (3) lowering power/range LOW enough to avoid thousands upon thousands of packets which must be processed at the same time from potentially hundreds of vehicles/sources.

In particular, the broadcast power modulating component of the control unit 20 is configured to selectively vary the broadcast power of the omni-directional antenna 31 and the broadcast power of the bi-directional antenna 32 based on the road segment attribute of a road on which the host vehicle 10 is traveling on as determined by the global positioning system 22 (the vehicle positioning component) using the map database 24 (the vehicle map component). Moreover, the bi-directional aiming component of the control unit 20 is configured to aim the bi-directional antenna 32 based on at least one of traffic information received by the host vehicle two way communication device 31 and the road segment attribute of the road on which the host vehicle is traveling on. Thus, the control of the omni-directional antenna 31 and the bi-directional antenna 32 is selectively determined on the road segment attribute, which is referred herein as the "Road Segment Attribute" method, and/or the sensed traffic information, which is referred herein as the "Center Of Directionality" method.

The host vehicle two way communication device 21A is configured to use the service channel to conduct private communications. In other words, an electronic handshake occurs between the host vehicle 10 and other vehicles or service providers. The host vehicle two way communication device 21A is configured to conduct direct short range communications in a host vehicle broadcast area surrounding the host vehicle 10 via the antennas 21B. In particular, the two-way wireless communication system 21 is preferably a dedicated short range communication systems, since the latency time between communications is very low compared to most other technologies that are currently available. However, other two-way wireless communication systems can be used if they are capable of conducting both point-to-point wireless communications and broadcast wireless messages in a limited broadcast area so log as the latency time between communications is short enough to carry out the present invention. When the two-way wireless communication system 21 is a DSRC system, the two-way wireless communication system 21 will transmit at a 75 Mhz spectrum in a 5.9 GHz band with a data rate of 1 to 54 Mbps, and a maximum range of about 1,000 meters. Preferably, the two-way wireless communication system 21 includes seven (7) non-overlapping channels. The two-way wireless communication system 21 will be assigned a Medium Access Control (MAC) address and/or an IP address so that each vehicle in the network can be individually identified.

The omni-directional antenna 31 can be any type of omni-directional antenna that can be used to carry out the present invention. Omni-directional antennas are conventional components that are well known in the art. Since omni-directional antennas are well known in the art, the structure of the omni-directional antenna 31 will not be discussed or illustrated in detail herein. Rather, it will be apparent to those skilled in the art from this disclosure that any type of structure and/or programming can be used so long that it can carryout the functions of the omni-directional antenna 31 as disclosed herein.

Figure 6:
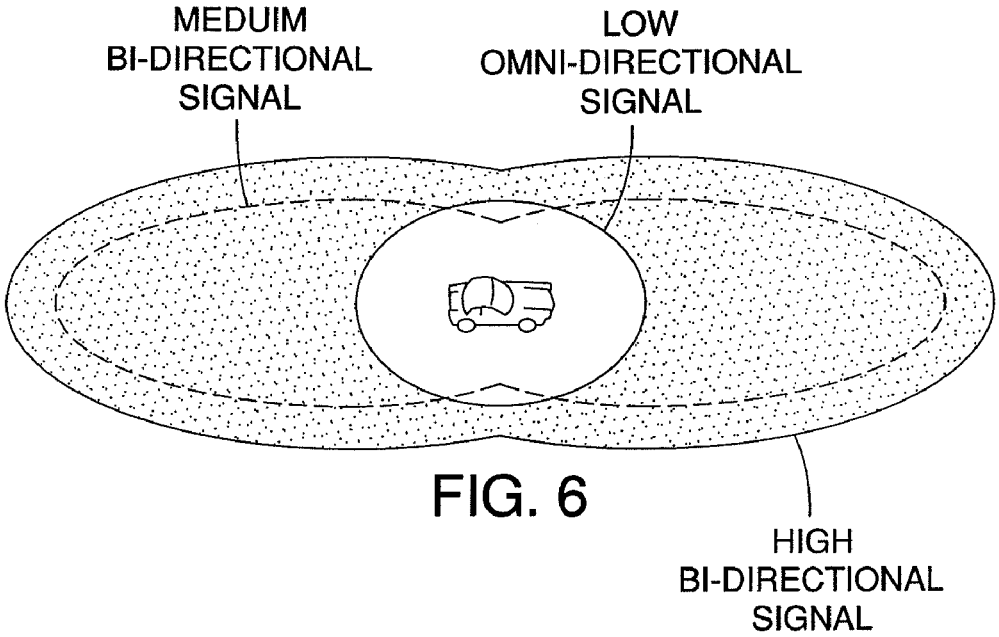
FIG. 6 is a pictorial representation of the host vehicle set to a highway mode with the non-shaded area representing the broadcast/receiving signal of the omni-directional antenna and the shaded area representing the broadcast/receiving signal of the bi-directional antenna.
Figure 7:
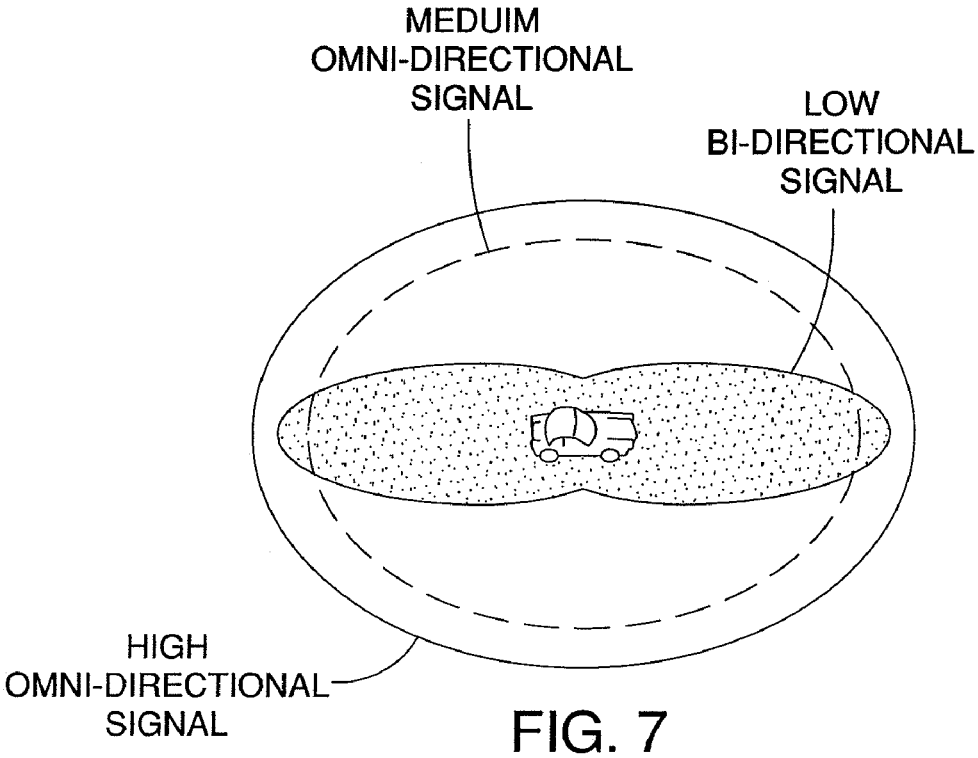
FIG. 7 is a pictorial representation of the host vehicle set to a non-highway mode with the non-shaded area representing the broadcast/receiving signal of the omni-directional antenna and the shaded area representing the broadcast/receiving signal of the bi-directional antenna.
Figure 8:
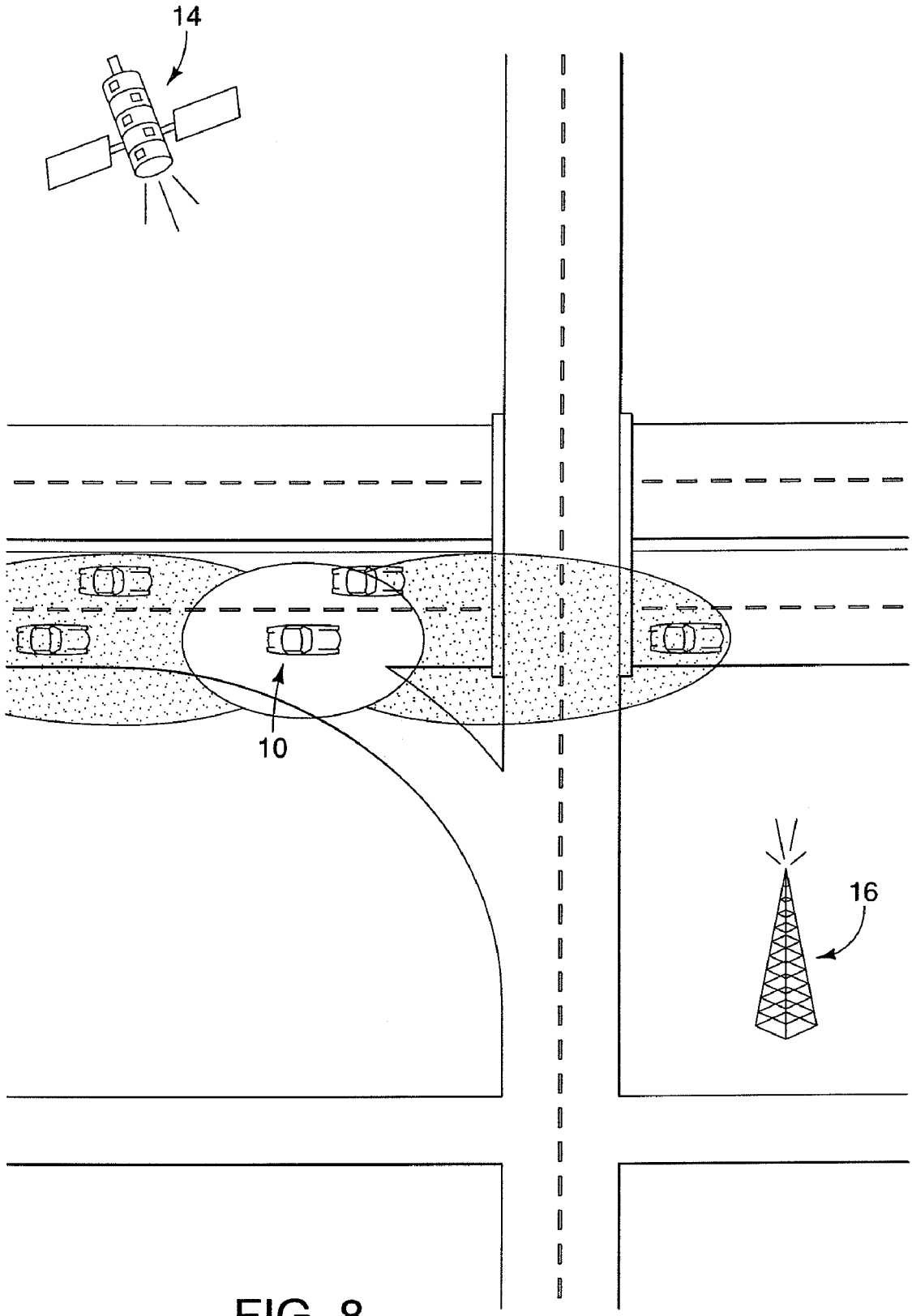
FIG. 8 is a pictorial representation of a road way with the host vehicle set to the highway mode with the non-shaded area representing the signal of the omni-directional antenna and the shaded area representing the signal of the bi-directional antenna.
Figure 9:
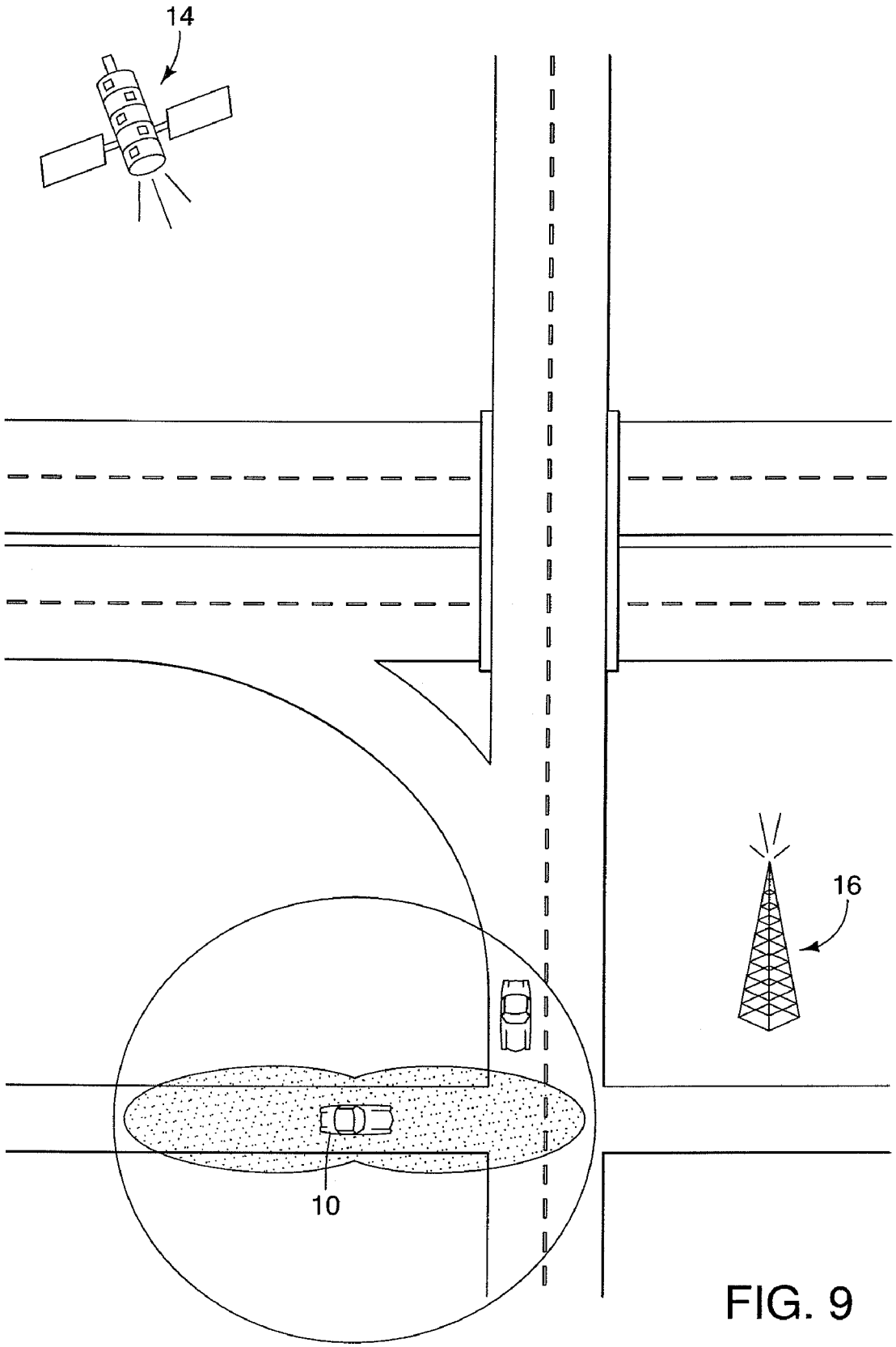
FIG. 9 is a pictorial representation of a road way with the host vehicle set to the non-highway mode with the non-shaded area representing the signal of the omni-directional antenna and the shaded area representing the signal of the bi-directional antenna.
Figure 10:
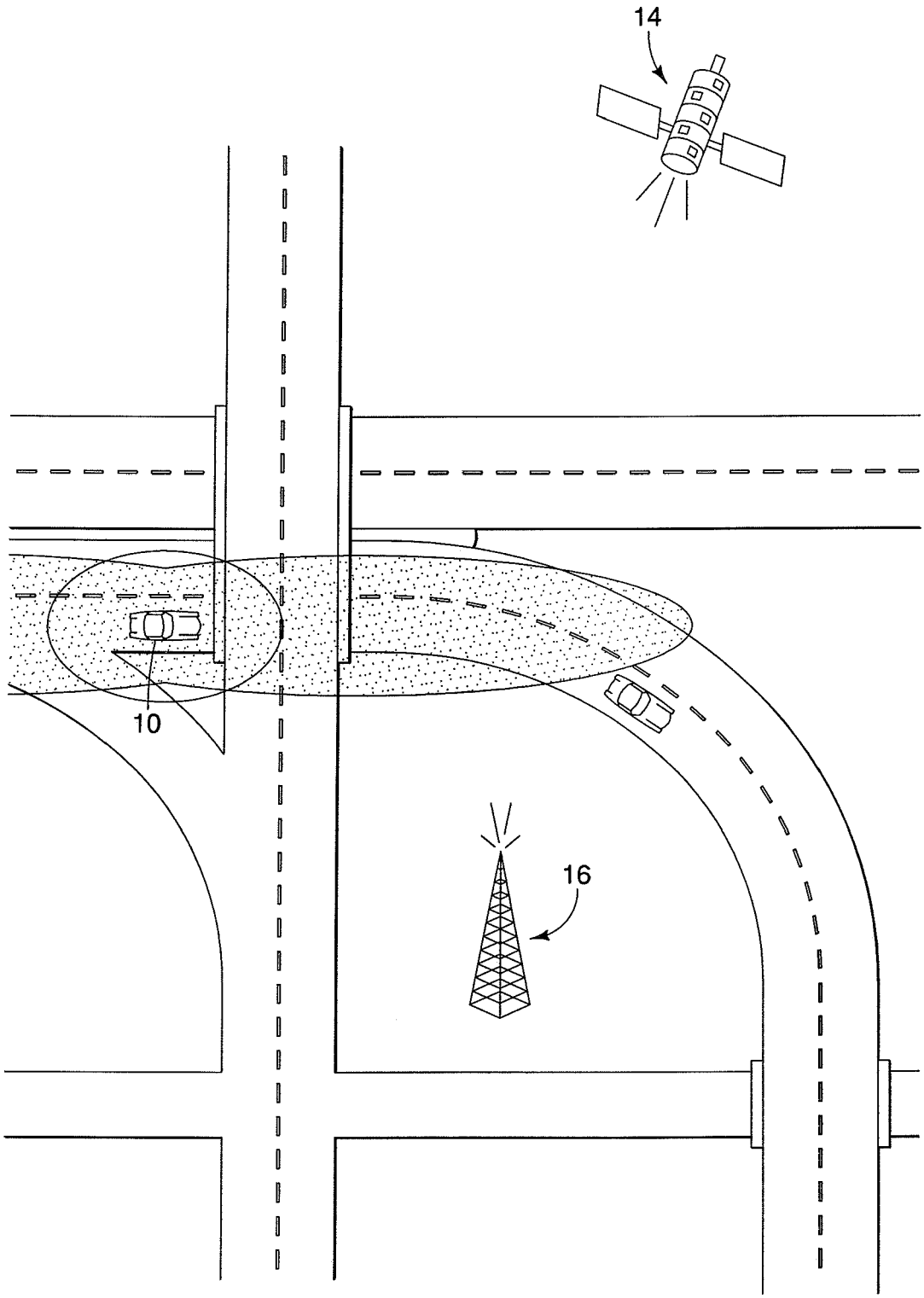
FIG. 10 is a pictorial representation of a road way with the host vehicle set to the highway mode prior to rotation of the bi-directional antenna with the non-shaded area representing the signal of the omni-directional antenna and the shaded area representing the signal of the bi-directional antenna.
Figure 11:
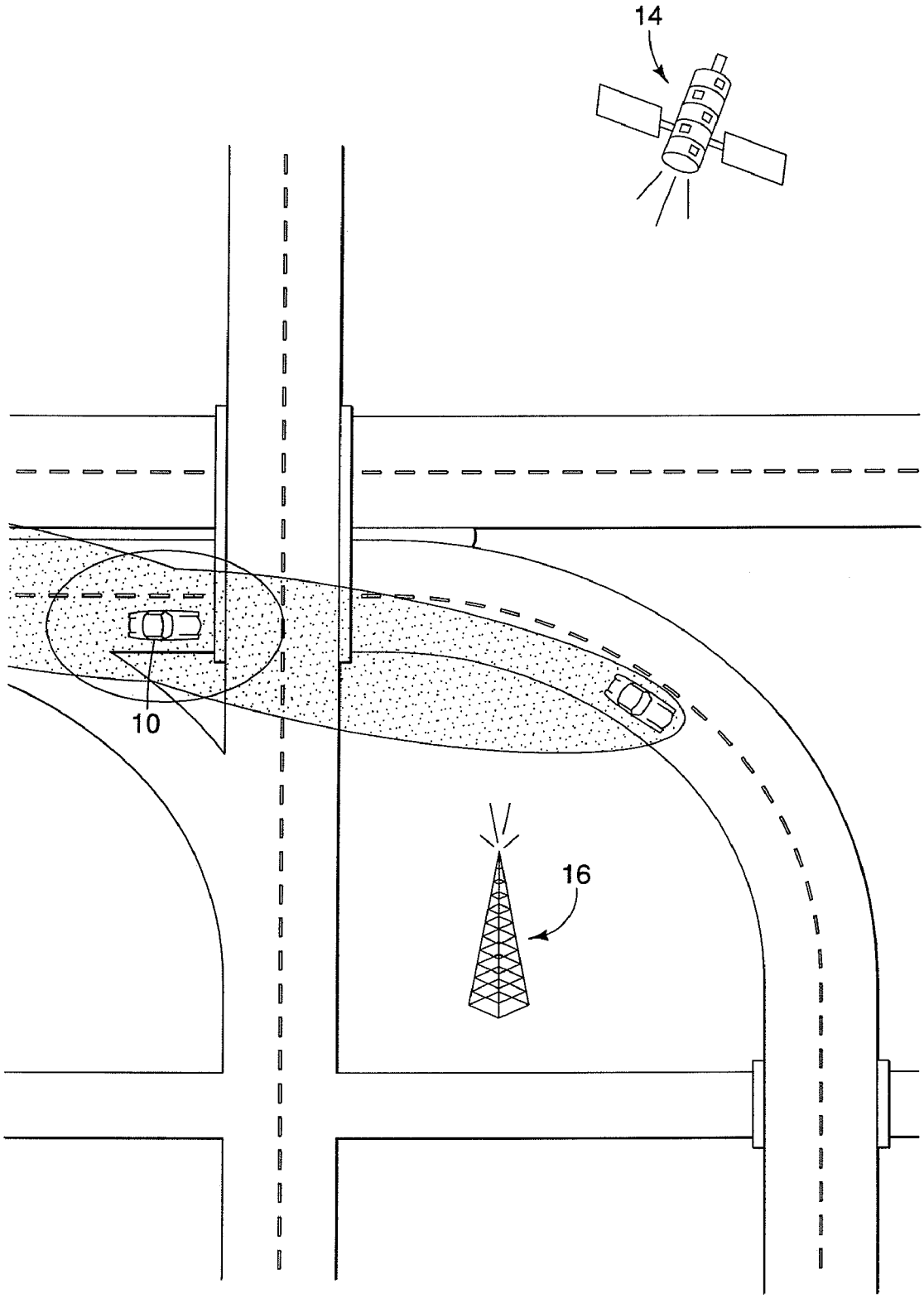
FIG. 11 is a pictorial representation of a road way with the host vehicle set to the highway mode after rotation of the bi-directional antenna with the non-shaded area representing the signal of the omni-directional antenna and the shaded area representing the signal of the bi-directional antenna.

The omni-directional antenna 31 outputs a generally circular or slightly oval RF signal as seen in FIGS. 6 and 7. The omni-directional antenna 31 is preferably configured with multiple power levels. For sake of simplicity, the omni-directional antenna 31 is illustrated with three broadcast power levels (e.g., "High, Medium & Low") in FIGS. 6 and 7. However, the omni-directional antenna 31 is more configured with more than three broadcast power levels. For example, more preferably, the omni-directional antenna 31 can be set to any broadcast power level between 0 and 20 at 0.5 increments. As illustrated in FIGS. 8-11, the broadcast power level of the omni-directional antenna 31 is preferably adjusted in a selective manner by the broadcast power modulating component of the control unit 20 based on the road segment attribute of a road on which the host vehicle 10 is traveling on as determined by the global positioning system 22 (the vehicle positioning component) using the map database 24 (the vehicle map component). For example, in the highway situation of FIG. 8, the broadcast power level of the omni-directional antenna 31 would be set to a low broadcast power level. On the other hand, in a non-highway situation of FIG. 9, the broadcast power level of the omni-directional antenna 31 would be set to a high broadcast power level. In addition to the road segment attribute of the road, vehicle operating conditions (e.g., speed, steering angle, etc.) can be used to determine the broadcast power level of the omni-directional antenna 31.

The bi-directional antenna 32 can be any type of bi-directional antenna that can be used to carry out the present invention. Bi-directional antennas are conventional components that are well known in the art. Since bi-directional antennas are well known in the art, the structure of the bi-directional antenna 32 will not be discussed or illustrated in detail herein. Rather, it will be apparent to those skilled in the art from this disclosure that any type of structure and/or programming can be used so long that it can carryout the functions of the bi-directional antenna 32 as disclosed herein.

The bi-directional antenna 32 outputs generally a pair of oval RF signals as seen in FIGS. 6 and 7. The bi-directional antenna 32 is preferably configured with multiple power levels. For sake of simplicity, the bi-directional antenna 32 is illustrated with three broadcast power levels (e.g., "High, Medium & Low") in FIGS. 6 and 7. However, the bi-directional antenna 32 is more configured with more than three broadcast power levels. For example, more preferably, the bi-directional antenna 32 can be set to any broadcast power level between 0 and 20 at 0.5 increments. As illustrated in FIGS. 8-11, the broadcast power level of the bi-directional antenna 32 is preferably adjusted in a selective manner by the broadcast power modulating component of the control unit 20 based on the road segment attribute of a road on which the host vehicle 10 is traveling on as determined by the global positioning system 22 (the vehicle positioning component) using the map database 24 (the vehicle map component). For example, in the highway situation of FIG. 8, the broadcast power level of the bi-directional antenna 32 would be set to a high broadcast power level. On the other hand, in a non-highway situation of FIG. 9, the broadcast power level of the bi-directional antenna 32 would be set to a low broadcast power level. In addition to the road segment attribute of the road, vehicle operating conditions (e.g., speed, steering angle, etc.) can be used to determine the broadcast power level of the bi-directional antenna 32.

Examples of road segment attributes and corresponding broadcast power levels for the omni-directional antenna 31 and the bi-directional antenna 32 are illustrated in the following table:

| ROAD SEGMENT ATTRIBUTE | | BROADCAST POWER LEVELS OF ANTENNAS | |
|---|---|---|---|
| Road Segment Type | Associated Attribute | Omni-directional antenna | Bi-directional antenna |
| Named or unnamed roads | Restricted Access | Low | High |
| Named or unnamed roads | Unrestricted Access | High | Low |
| Named or unnamed roads | Bridge | Low | High |
| Named or unnamed roads | Tunnel | Low | High |
| Ferry connection | | Low | Low |
| Undefined Traffic Areas | | High | Low |
| Named or unnamed roads | | Medium | Medium |
| Roundabouts | | High | Low |
| Special Traffic Figures | | High | Low |
| Turn Lanes | | High | Low |
| Restricted U-turn Lanes | | High | Low |
| Frontage Roads | | Medium | High |
| Pedestrian Streets Zones | | High | Low |

Of course, these road segment attributes are merely examples. The road segment attributes can be based solely on either the road segment type or the associated attributes or some other classification. For example, the road segment attributes can be based on one or more of the following factors: road accessibility level, speed limit, lane number, population in the area, etc.

Per the core idea, the antenna controller should checked the identified/recognized road segment and determine the appropriate power level for each antenna given that condition. One embodiment is shown using the NavTeq segment identifiers along with potential power levels for an example of how the controller might react. This combination of "Road Segment" and "Associated Attribute" could either be extracted from the navigational database (internal to the vehicle; option), or could be communicated by a Roadside Unit (RSU) at a transition point (e.g. onramp for a highway).

Figure 12:
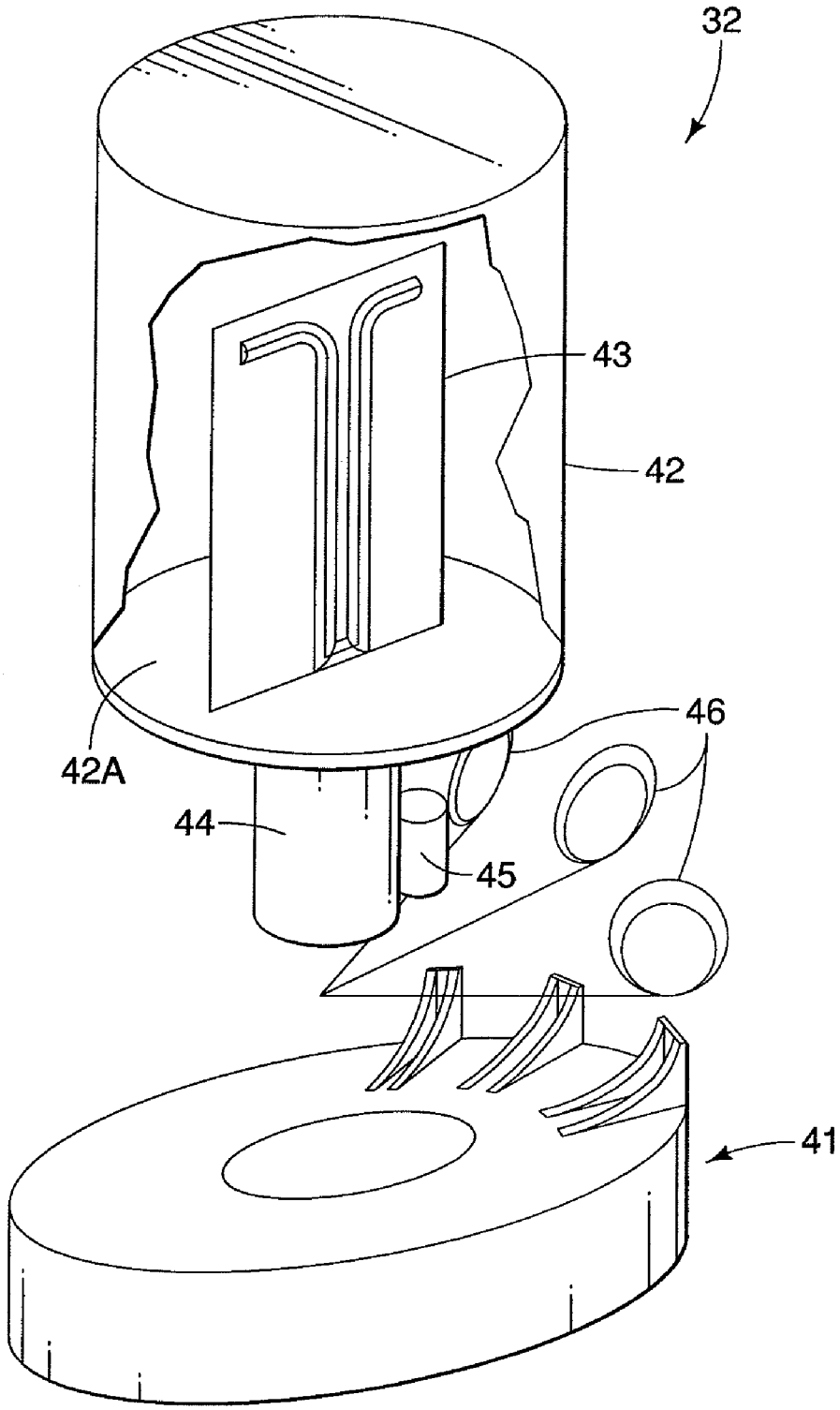
FIG. 12 is a simplified, exploded perspective view of the rotatable bi-directional antenna representation with a portion of the housing broken away for purposes of illustration.

As seen in FIG. 12, one example of the bi-directional (multi-directional) antenna 32 is illustrated in accordance with one aspect of the present invention. The bi-directional (multi-directional) antenna 32, shown in FIG. 12, basically includes a fixed base 41, a housing 42 with a bi-directional antenna card 43, a rotating stanchion 44 with a magnet 45 and three electric coils 46. The fixed base 41 is fixedly attached to the host vehicle 10 using any suitable fastening structure. The housing 42 with the bi-directional antenna card 43 is mounted to the fixed base 41 to rotate about a vertical axis. Rotation of the housing 42 relative to the fixed base 41 is controlled by energizing the electric coils 46 from electric energy from the vehicle battery (not shown). Thus, the bi-directional antenna 32 is a rotating, directional, bipolar antenna (referred to herein as "Rotenna").

If one of the electric coils 46 were charged, the magnetic field created would attract the magnet 45 on the rotating stanchion 44 and orient the antenna card 43 in that direction. If the two of the electric coils 46 were charged equally, the magnetic field would orient the antenna card 43 to a middle point between the two of the electric coils 46 that were equally charged. Thus, the antenna card 43 could have infinite positions between the electric coils 46 by activating a varying amount of power to each of the electric coils 46. This would allow the antenna directionality to vary slightly based upon calculations of the nearby signals. The RF signal of the would not be affected by the magnet 45 and the electric coils 46 by placing a simple shield (base of the housing 42 between the antenna card 43 and the electric coils 46, and running the antenna wire through the rotating stanchion 44 and out the fixed base 41.

As mentioned above, the broadcast power modulating component of the control unit 20 is configured to selectively vary the broadcast power of the bi-directional antenna 32 based on the road segment attribute of the road on which the host vehicle is traveling on. Moreover, the bi-directional aiming component of the control unit 20 is configured to aim the bi-directional antenna 32 based on at least one of traffic information received by the host vehicle two way communication device 31 and the road segment attribute of the road on which the host vehicle is traveling on.

Thus, the bi-directional antenna 32 helps focus the signal towards the distant traffic slightly off center of the vehicle's path, but it wouldn't decipher which antenna to use if both of the antennas 31 and 32 were available and within range. Here, the system would use a standard diversity tactic, and analyze the two signals for optimal performance. For instance, if the signals from the two antennas 31 and 32 arrive at the same time, adding the signals together could increase the strength of the signal.

However, due to multi-path reception of the various input signals, it is possible that the signals arrive out of phase, which could create bit error problems or signal attenuation/blockage if considered in concert. Therefore, employing the signals in an intelligent fashion would be desirable to employing such a "smart antenna system" design.

For example, if the system intelligently investigates the Signal-to-Noise Ratio (S/N), the system can remain on one of the antennas 31 or 32 and only vary when necessary. The calculations below would be sample calculations for either strategy of evaluating the important signals, but are not imperative to the concept of the invention. First, the system should decide if the S/N is acceptable for the antenna presently being monitored. For a single transmission source, this is not difficult. However, if multiple vehicles or roadside units exist in the broadcast area, the system must decide if the most important messages are being heard.

For a single transmission source, if S/N<"x", switch to the other antenna; otherwise monitor present antenna for "y" signals (per Besser Associates, a S/N of 12 allows for a Bit Error Rate of $10^{-8}$ which would be desirable considering DSRC systems would carry safety-related communications).

For multiple transmission sources, first, determine the closest vehicle with a forward weighting of "w" as follows:

$$\text{Distance (d)}=[(\text{fore})^2+(\text{side})^2]^{1/2}/\text{w}$$

Where:

fore=GPS distance to transmitter in vector of present velocity, side=GPS distance to transmitter perpendicular to vector of present velocity w=2 if fore/side>c (c equals a constant, i.e. significantly in front of vehicle)

w=1 if fore<0 (transmitter is behind the owner's vehicle) or fore/side<c (transmitter is not significantly in front of vehicle)

If one transmitter is sending a high-priority broadcast message, it should overrule this selective listening strategy.

Next, if S/N<"x" for the closest vehicle, switch to the other antenna. Otherwise, continue to monitor the present antenna for "y" consecutive signals. After "y" signals, check the opposite antenna S/N and switch back if lower than the original S/N.

For the bi-directional antenna 32, a parallel strategy might be employed by essentially calculating a center of directionality (COD), as indicated below, between all recognized antennas, and considering that the desirable directionality for the bi-directional antenna 32 (again with a bias towards vehicles significantly fore/aft of the vehicle).

$$COD=\tan^{-1}[\Sigma w_n(side)_n]/[\Sigma w_n(fore)_n]$$

The global positioning system 22 is a conventional global positioning system (GPS) that is configured and arranged to receive global positioning information of the host vehicle 10 in a conventional manner. Basically, the global positioning system 22 includes a GPS unit 22A that is a receiver for receiving a signal from the global positioning satellite 18 via and a GPS antenna 22B. The signal transmitted from the global positioning satellite 18 is received at regular intervals (e.g. one second) to detect the present position of the host vehicle. The GPS unit 22A preferably has an accuracy of indicting the actual vehicle position within a few meters or less. This data (present position of the host vehicle) is fed to the control unit 20 for processing and to the navigation system 23 for processing.

As mentioned above, preferably, the vehicle on-board unit 12 of the present invention is integrated into the navigation system 23. The navigation system 23 is preferably a conventional navigation system that is configured and arranged to receive global positioning information of the vehicle 10 through a global positioning system (GPS) 23A based on the signals transmitted from the global positioning satellites 14. Preferably, inputting and displaying parts of the vehicle communication system are built into the navigation system 23. Basically, the navigation system 23 includes a color display unit 23A and an input controls 23B. The navigation system 23 can have its own controller with microprocessor and storage, or the processing for the navigation system 23 can be executed by the control unit 20. In either case, the signals transmitted from the global positioning satellites 14 are utilized to guide the vehicle 10 in a conventional manner.

The navigation system 23 includes the functions of the navigational systems that are installed into vehicles, including, but not limited to, detecting, mapping, tracking and map-matching location of the installed vehicle using the global positioning system 22, and the map database 24. During a trip (which may be hours in length), the navigation system 23 will continue to give "next maneuver" instructions to the user in a conventional manner.

Figure 5:
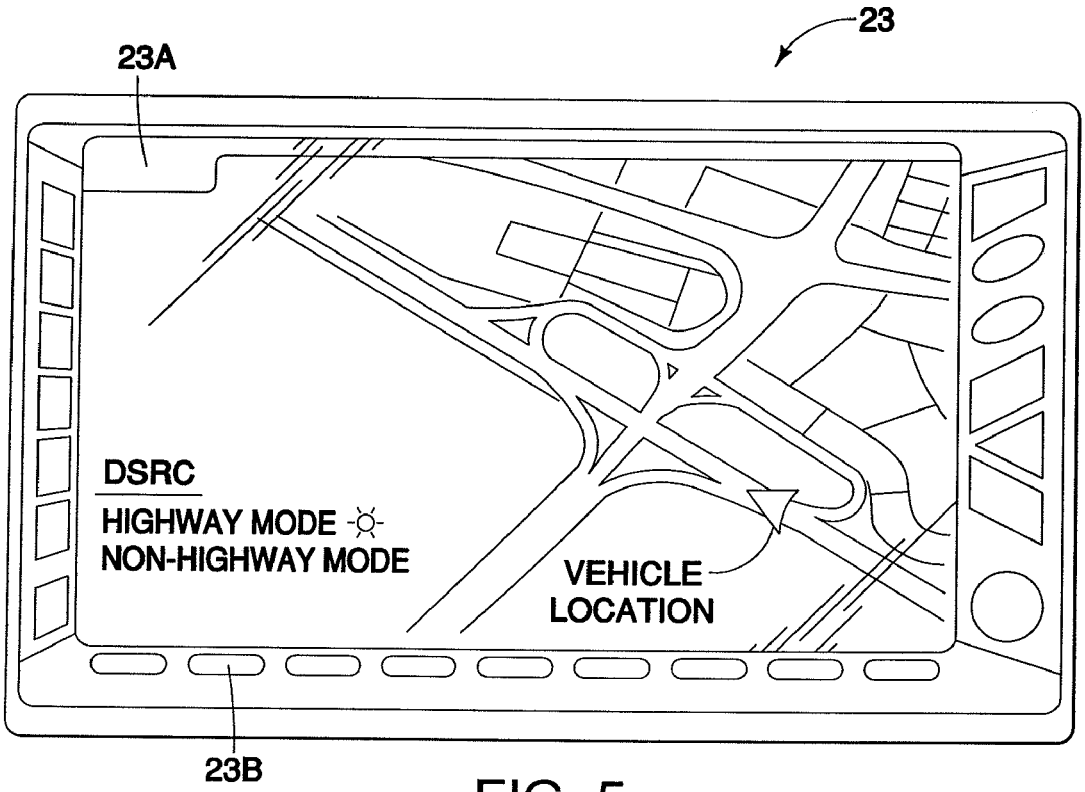
FIG. 5 is a pictorial representation of a navigation screen display of the vehicle's navigation system that is integrated with the on-board unit in accordance with the present invention.

In the illustrated embodiment, the color display unit 23A constitutes an output part of the vehicle communication system. The color display unit 23A is configured to display both navigational maps and data such as seen in FIG. 5. Thus, the navigation system 23 can be utilized to direct the host vehicle 10 to a destination that is inputted.

Thus, the color display unit 23A is controlled by the control unit 20 to display screens such as the one shown in FIG. 5 as well as other screens that are not shown. Preferably, the color display unit 23A is a touch screen so that it also forms part of the vehicle communication system. The input controls 23B also forms part of the vehicle communication system. In other words, the color display unit 23A and the input controls 23B constitutes a host vehicle user input device that is manually operated by the user to setup the vehicle communication system 21.

The map database 24 is part of a storage section or component that is configured to store road map data as well as other data that can be associated with the road map data such as various landmark data, fueling station locations, restaurants, etc. The map database 24 preferably includes a large-capacity storage medium such as a CD-ROM (Compact Disk-Read Only Memory) or IC (Integrated Circuit) card. The map database 24 is configured to perform a read-out operation of reading out data held in the large-capacity storage medium in response to an instruction from the control unit 20 and/or the navigation system 23.

The map database storage section 24 is used by the control unit 20 to acquire the map information necessary as needed and/or desired to selectively control the two way communication device 30, the omni-directional antenna 31 and the bi-directional antenna 32 to minimize the DSRC interference and backend calculations. The map database 24 is also used by the control unit 20 to acquire the map information necessary as needed and/or desired for guiding the host vehicle 10 to selected destination. Thus, the map database storage section 24 is also used by the navigation system 23 to acquire the map information necessary for route guiding, map display, and direction guide information display.

Preferably, the map information of this embodiment includes at least information necessary for offering of the map information and route guiding as performed by a general navigation device and necessary for displaying the direction guide information of the embodiment. The map information also includes at least road links indicating connecting states of nodes, locations of branch points (road nodes), names of roads branching from the branch points, and place names of the branch destinations, and has such a data structure that, by specifying a location of interest, information on the corresponding road and place name can be read. The map information of the map database storage section 24 stores road information for each road link or node. The road information for each road link or node includes identification information of a road such as a road name, attribute information (road type—local road, unrestricted access, restricted access, bridge, tunnel, roundabout, etc.), a road width or number of lanes, a connection angle of a road at a branch point, and etc, In particular, the broadcast power modulating component of the control unit 20 is configured to selectively vary the broadcast power of the omni-directional antenna 31 and the broadcast power of the bi-directional antenna 32 based on the road segment attribute of a road on which the host vehicle 10 is traveling on as determined by the global positioning system 22 (the vehicle positioning component) using the map database 24 (the vehicle map component). Moreover, the bi-directional aiming component of the control unit 20 is configured to aim the bi-directional antenna 32 based on at least one of traffic information received by the host vehicle two way communication device 31 and the road segment attribute of the road on which the host vehicle is traveling on.

Figure 13:
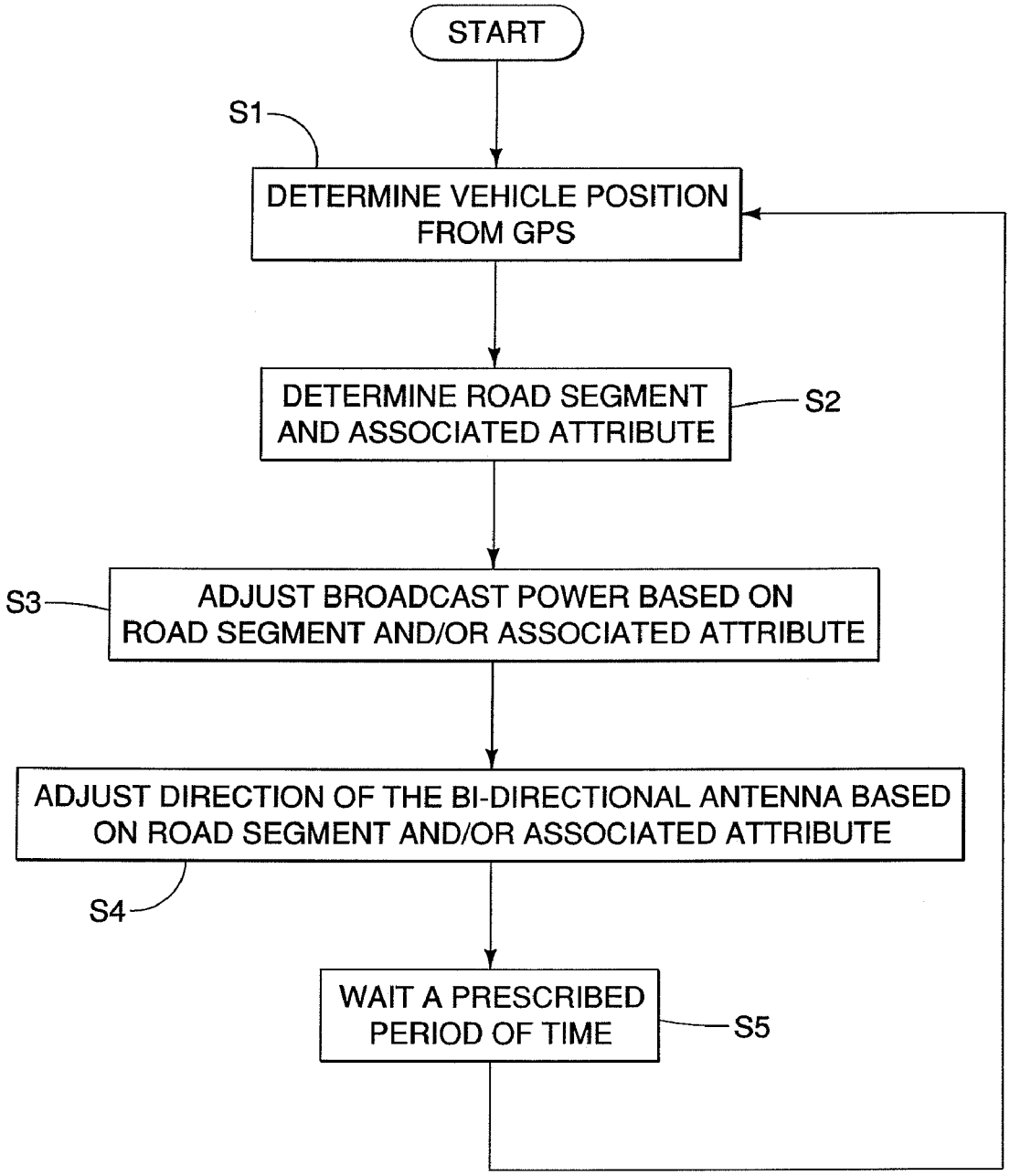
FIG. 13 is a flow chart illustrating the processing executed by the control unit to determine control the omni-directional antenna and the bi-directional antenna in accordance with the present invention.

Referring now to FIG. 13, one possible process that can be executed by the control unit 20 to carry out the present invention will now be discussed. This process of FIG. 13 is limited to the processing executed in the host vehicle 10. The control unit 20 and its various components will be typically activated when the user turns the ignition key to the "ON" position or the "Accessory" position. Thus, the ignition switch sensor is configured and arranged to activate the control unit 20 and start the process of FIG. 13.

In step S1, the control unit 20 is configured to first determine the host vehicle's position from the global positioning system 22 (GPS). Once the host vehicle's position is determined from the global positioning system 22 (GPS), the processing executed by the control unit 20 of the host vehicle 10 then proceeds to step S2.

In step S2, the control unit 20 is configured to first determine the road segment and associated attribute (i.e., the road segment attribute) of the road on which the host vehicle is traveling on. This information can be obtained from the map database 24 on the host vehicle or can be obtained from one of the satellites 14 and/or one of the roadside units 16. Once the road segment attribute of the road is determined, the processing executed by the control unit 20 of the host vehicle 10 then proceeds to step S3.

In step S3, the control unit 20 is configured to adjusts the broadcast power of the omni-directional antenna 31 and the bi-directional antenna 32 based on the road segment and associated attribute (i.e., the road segment attribute) of the road on which the host vehicle is traveling on.

Once the control unit 20 has adjusted the broadcast power of the omni-directional antenna 31 and the bi-directional antenna 32, the processing executed by the control unit 20 of the host vehicle 10 then proceeds to step S4.

In step S4, the control unit 20 is configured to adjusts the direction (angle) of the bi-directional antenna 32 based on the road segment and associated attribute (i.e., the road segment attribute) of the road on which the host vehicle is traveling on.

Finally, after the direction (angle) of the bi-directional antenna 32 is adjusted, the processing executed by the control unit 20 of the host vehicle 10 then proceeds to step S4, where the control unit 20 waits for a prescribed period of time before readjusting the broadcast power of the antennas 31 and 32, and/or readjusting the direction (angle) of the bi-directional antenna 32. This prescribed waiting period of time can be a fixed period of time or can vary based on detected parameters such as the road segment attribute and/or vehicle operating conditions (e.g., speed, steering angle, etc.).

As used herein to describe the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed. For example, these terms can be construed as including a deviation of at least ± 5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A vehicle communication system comprising:

a host vehicle two way communication device configured to conduct short range communications in a host vehicle broadcast area surrounding a host vehicle equipped with the vehicle communication system;

an omni-directional antenna operatively coupled to the host vehicle two way communication device to conduct short range communications in the host vehicle broadcast area surrounding the host vehicle;

a bi-directional antenna operatively coupled to the host vehicle two way communication device to conduct short range communications in the broadcast area surrounding the host vehicle;

a vehicle positioning component configured to determine a host vehicle position of the host vehicle;

a vehicle map component including road data with roads being classified by at least one of a road segment attribute; and a vehicle broadcast power modulating component configured to selectively vary broadcast power of the omni-directional antenna and broadcast power of the bi-directional antenna based on the road segment attribute of a road on which the host vehicle is traveling on as determined by the vehicle positioning component.

2. The vehicle communication system according to claim 1, wherein the host vehicle two way communication device includes a dedicated short-wave radio communication device.

3. The vehicle communication system according to claim 1, wherein the vehicle map component is configured to define the road segment attribute in accordance with an accessibility level to the road.

4. The vehicle communication system according to claim 1, wherein the vehicle map component is configured to define the road segment attribute in accordance with a type of road segment.

5. The vehicle communication system according to claim 1, wherein the vehicle map component is configured to receive the road data from an on-board database.

6. The vehicle communication system according to claim 1, wherein the vehicle map component is configured to receive the road data from an external source.

7. The vehicle communication system according to claim 1, further comprising a bi-directional antenna aiming component configured to aim the bi-directional antenna based on the road segment attribute of the road on which the host vehicle is traveling on.

8. The vehicle communication system according to claim 7, wherein the vehicle map component is configured to define the road segment attribute in accordance with at least one of an accessibility level to the road and a type of road segment.

9. The vehicle communication system according to claim 1, further comprising a bi-directional antenna aiming component configured to aim the bi-directional antenna based on traffic information received by the host vehicle two way communication device.

10. The vehicle communication system according to claim 9, wherein the vehicle map component is configured to define the road segment attribute in accordance with at least one of an accessibility level to the road and a type of road segment.

11. The vehicle communication system according to claim 1, wherein the broadcast power of the omni-directional antenna is incrementally adjustable between a plurality of different power levels.

12. The vehicle communication system according to claim 1, wherein the broadcast power of the bi-directional antenna is incrementally adjustable between a plurality of different power levels.

13. The vehicle communication system according to claim 12, wherein the broadcast power of the omni-directional antenna is incrementally adjustable between a plurality of different power levels.

14. A vehicle communication system comprising:

a host vehicle two way communication device configured to conduct short range communications in a host vehicle broadcast area surrounding a host vehicle equipped with the vehicle communication system;

an omni-directional antenna operatively coupled to the host vehicle two way communication device to conduct short range communications in the host vehicle broadcast area surrounding the host vehicle;

a bi-directional antenna operatively coupled to the host vehicle two way communication device to conduct short range communications in the broadcast area surrounding the host vehicle, the bi-directional antenna being configured to be selectively aimed within a predetermined range of movement;

a vehicle positioning component configured to determine a host vehicle position of the host vehicle;

a vehicle map component including road data with roads being classified by at least one of a road segment attribute; and a bi-directional antenna aiming component configured to aim the bi-directional antenna based on at least one of traffic information received by the host vehicle two way communication device and the road segment attribute of the road on which the host vehicle is traveling on.

15. The vehicle communication system according to claim 14, wherein the host vehicle two way communication device includes a dedicated short-wave radio communication device.

16. The vehicle communication system according to claim 14, wherein the vehicle map component is configured to define the road segment attribute in accordance with an accessibility level to the road.

17. The vehicle communication system according to claim 14, wherein the vehicle map component is configured to define the road segment attribute in accordance with a type of road segment.

18. The vehicle communication system according to claim 14, wherein the vehicle map component is configured to receive the road data from an on-board database.

19. The vehicle communication system according to claim 14, wherein the vehicle map component is configured to receive the road data from an external source.

* * * * *